US007540046B1

(12) United States Patent
Lai

(10) Patent No.: US 7,540,046 B1
(45) Date of Patent: Jun. 2, 2009

(54) CRIB RAILING

(76) Inventor: Chin-I Lai, No. 96, Zhengbei 1st Rd., Yongkang City, Tainan County (TW)

( * ) Notice: Subject to any disclaimer, the term of this patent is extended or adjusted under 35 U.S.C. 154(b) by 0 days.

(21) Appl. No.: 12/236,643

(22) Filed: Sep. 24, 2008

(51) Int. Cl.
*A47D 7/00* (2006.01)

(52) U.S. Cl. ..... 5/100; 49/55; 49/57; 49/463; 49/465; 256/26; 292/163; 292/165; 292/DIG. 29

(58) Field of Classification Search ..... 5/93.1–100, 5/425, 430; 256/25, 26; 49/57, 58, 463, 49/465; 292/163, 165, DIG. 29
See application file for complete search history.

(56) References Cited

U.S. PATENT DOCUMENTS 4,959,878 A * 10/1990 Essek ..... 5/424
5,485,699 A * 1/1996 Gabhart ..... 49/394
7,426,758 B1 * 9/2008 Jones ..... 5/100

* cited by examiner

*Primary Examiner*—Alexander Grosz
(74) *Attorney, Agent, or Firm*—Frenkel & Associates, P.C.

(57) ABSTRACT

A crib railing includes a driving means, an opening/closing means and a railing coupling with the driving means and the opening/closing means. The driving means' seat has a top surface formed as a helical parabolic surface to allow the railing to automatically return at any angles relative to the driving means. The opening/closing means has an upper cover, a depressing means, a handgrip means, a slider, a lower cover and a linkage bar. The depressing means and handgrip means are single-handed operable at meantime, and can drive the linkage bar running through the handgrip means up and down to form an open or latch relationship with the railing. The handgrip means has a wedge with an inclined member to drive the slider to latch on a latch member of the railing. The invention provides the opening/closing movements of the driving means and opening/closing means and swiveling return of the railing.

20 Claims, 15 Drawing Sheets

CRIB RAILING

FIELD OF THE INVENTION

The present invention relates to a crib railing and particularly to a crib railing that has a driving means and an opening/closing means to open and close a railing of a crib and automatically return the railing to a closed position by swiveling to save manpower and provide greater safety and protection.

BACKGROUND OF THE INVENTION

A crib railing mainly aims to provide protection function by guarding small children from walking out from a safe domain. Safety is the most important issue in railing design. The conventional crib railing usually only has a swiveling railing. Such a structure leaves a lot to be desired in terms of safety. To remedy this drawback, a railing opening/closing structure including a spring has been developed. The spring can store an elastic force to automatically return the railing to the original closed position. But it does not provide a secured fastening means after closing. The safety issue still is not fully resolved.

Refer to FIGS. 1 and 2 for a conventional railing opening/closing structure 10. It includes an anchor post 11, a latch bar 12, a railing 13 bridging the anchor post 11 and latch bar 12, a spring (not shown in the drawings) and a fastening means (not shown in the drawings). The anchor post 11 has a seat 111 at an upper side. The seat 111 has an inclined top surface 112 and at least two notches 113 and 114 formed thereon. One notch 113 is located at the bottom of the top surface of the seat 111, and another notch 114 is spaced from the notch 113 at a selected distance. The railing 13 may be moved outward or inward and opened purposely at an angle of 90 degrees or wider. The rotary member 131 has a stub 132, opposing the anchor post 11, wedging in the notch 114, not the notch 113, to maintain the railing 13 in the open condition at the angle of 90 degrees or wider. But the railing 13 cannot be opened at any other angles or returned automatically through the inclined top surface 112 of the seat 111.

SUMMARY OF THE INVENTION

The primary object of the present invention is to provide a crib railing that has automatic return function and an opening/closing means to make opening and closing easier.

The two above functions can enhance safety and protection. The crib railing according to the invention has a driving means, an opening/closing means and a railing coupling with the driving means and the opening/closing means. The driving means has a seat which has a top surface formed as a helical parabolic surface to allow the railing to automatically return at any angles relative to the driving means. The opening/closing means has an upper cover, a depressing means, a handgrip means, a slider, a lower cover and a linkage bar. The depressing means and handgrip means are single-handed operable at meantime, and can drive the linkage bar running through the handgrip means up and down to form an open or closed relationship with the railing. The handgrip means has a wedge-shaped inclined element to drive the slider to latch on a latch member of the railing. Through the opening/closing operation of the driving means and opening/closing means and swiveling return of the railing, a labor-saving automatic return function can be accomplished and safety can be enhanced to provide desired protection.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
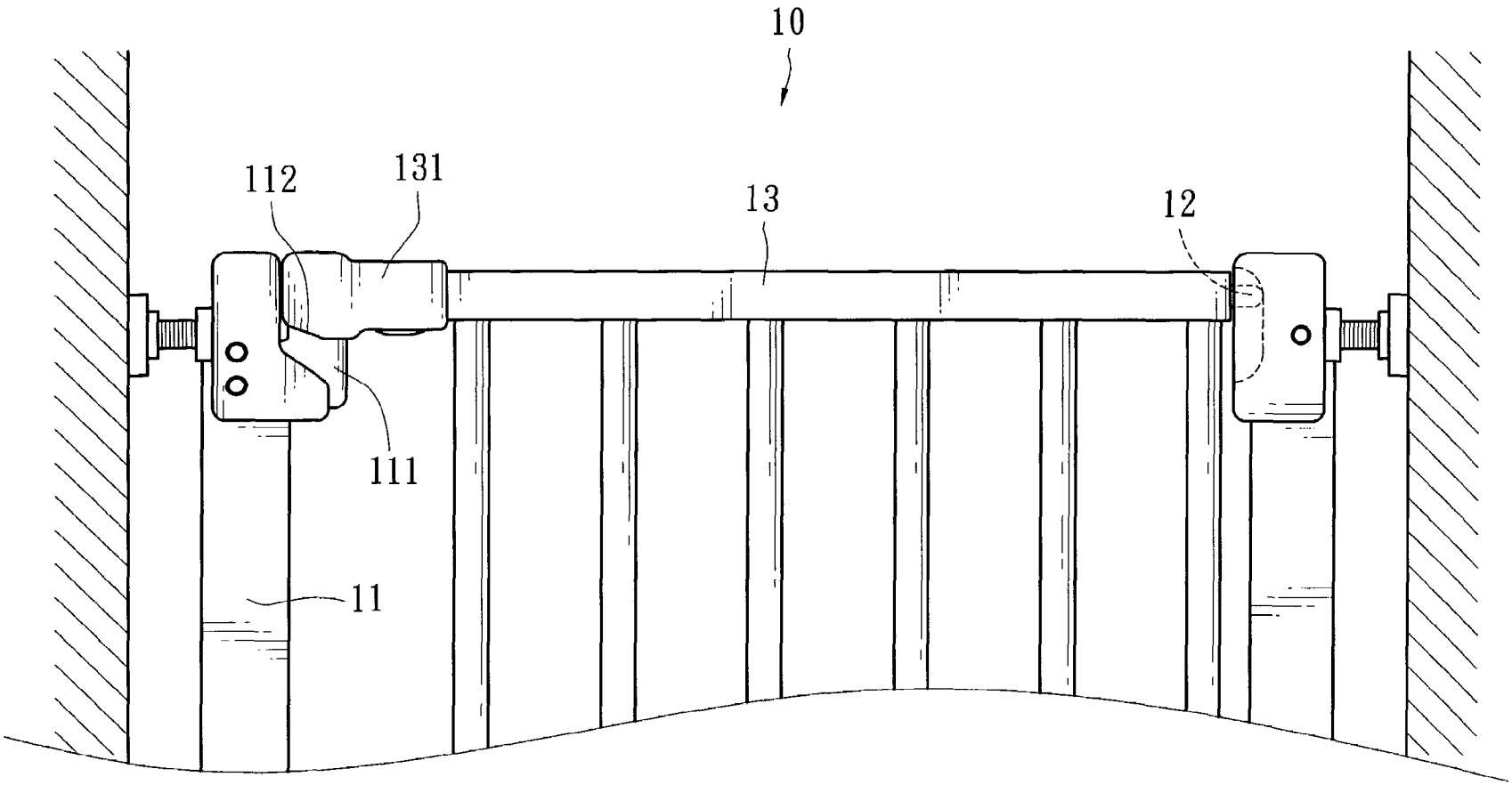
Fig. 1 PRIOR ART
FIG. 1 is a perspective view of a conventional railing opening/closing structure.
Figure 2:
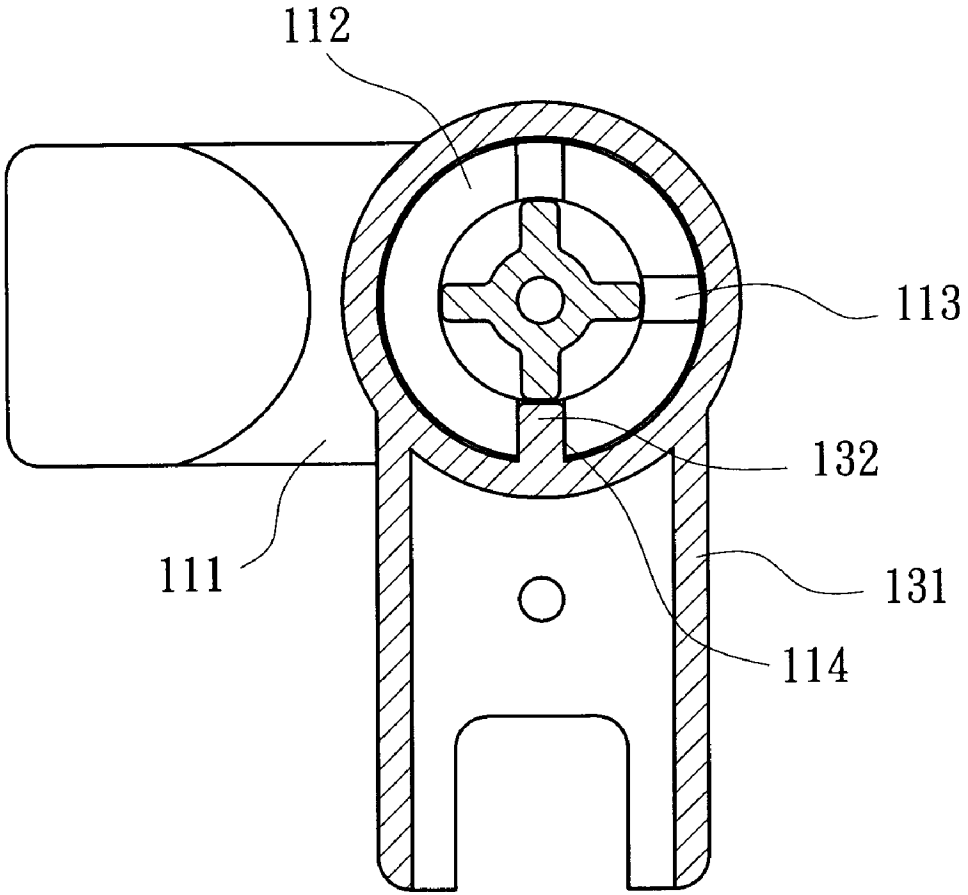
Fig. 2 PRIOR ART
FIG. 2 is a fragmentary sectional view of a conventional railing in an open condition.
Figure 3:
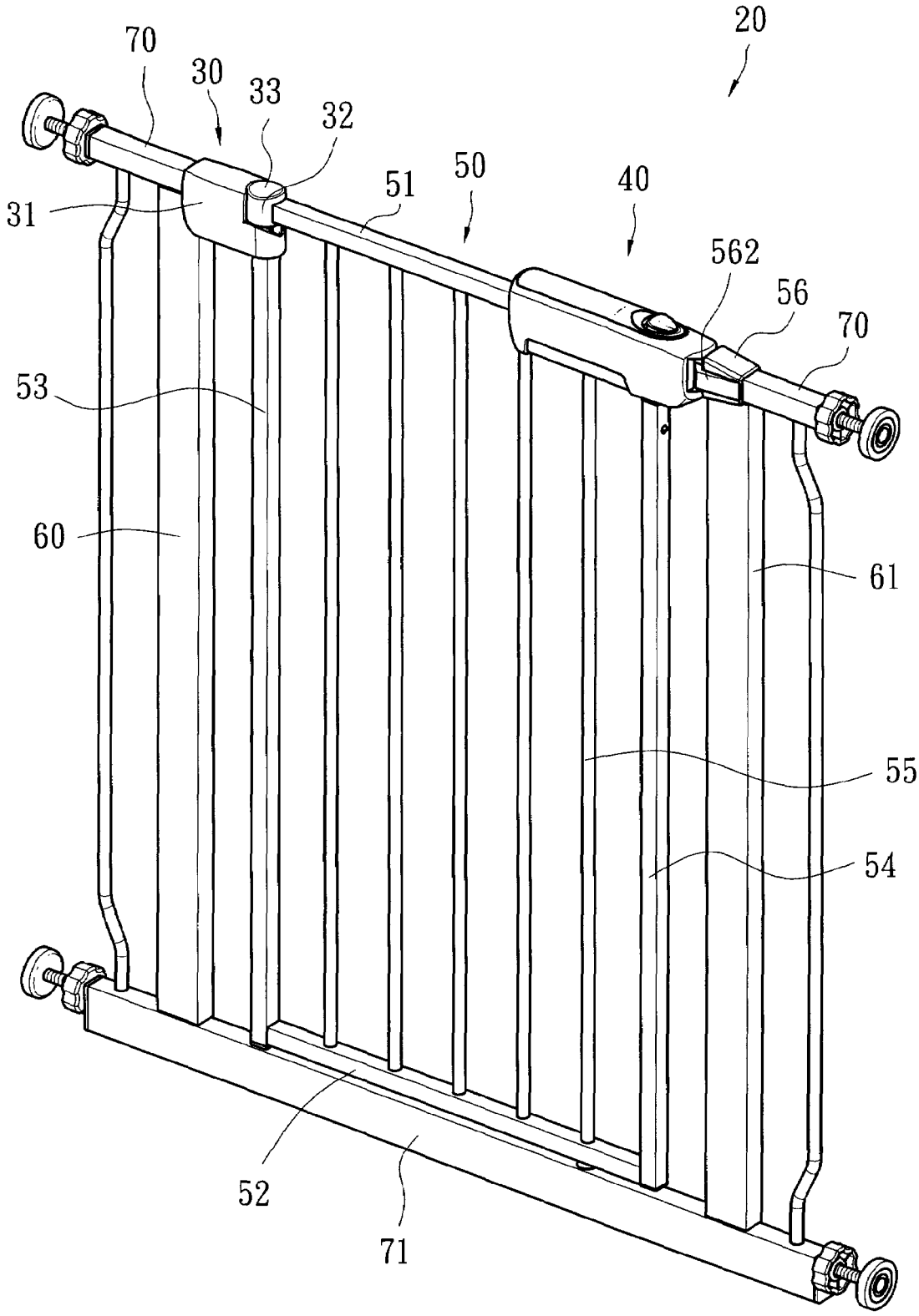
FIG. 3 is a perspective view of the crib railing of the invention.

Please referring to FIG. 3, the invention provides a crib railing 20 which includes a driving means 30, an opening/closing means 40 and a railing 50 which has one end coupled with the driving means 30 and another end has a latch member 56 latched on the opening/closing means 40. It also has an upper transverse bar 51, a lower transverse bar 52, a left post 53, a right post 54 and a plurality of bracing bars 55 that are surrounded by a left anchor post 60, a right anchor post 61, an upper beam 70 and a lower beam 71.

Figure 4:
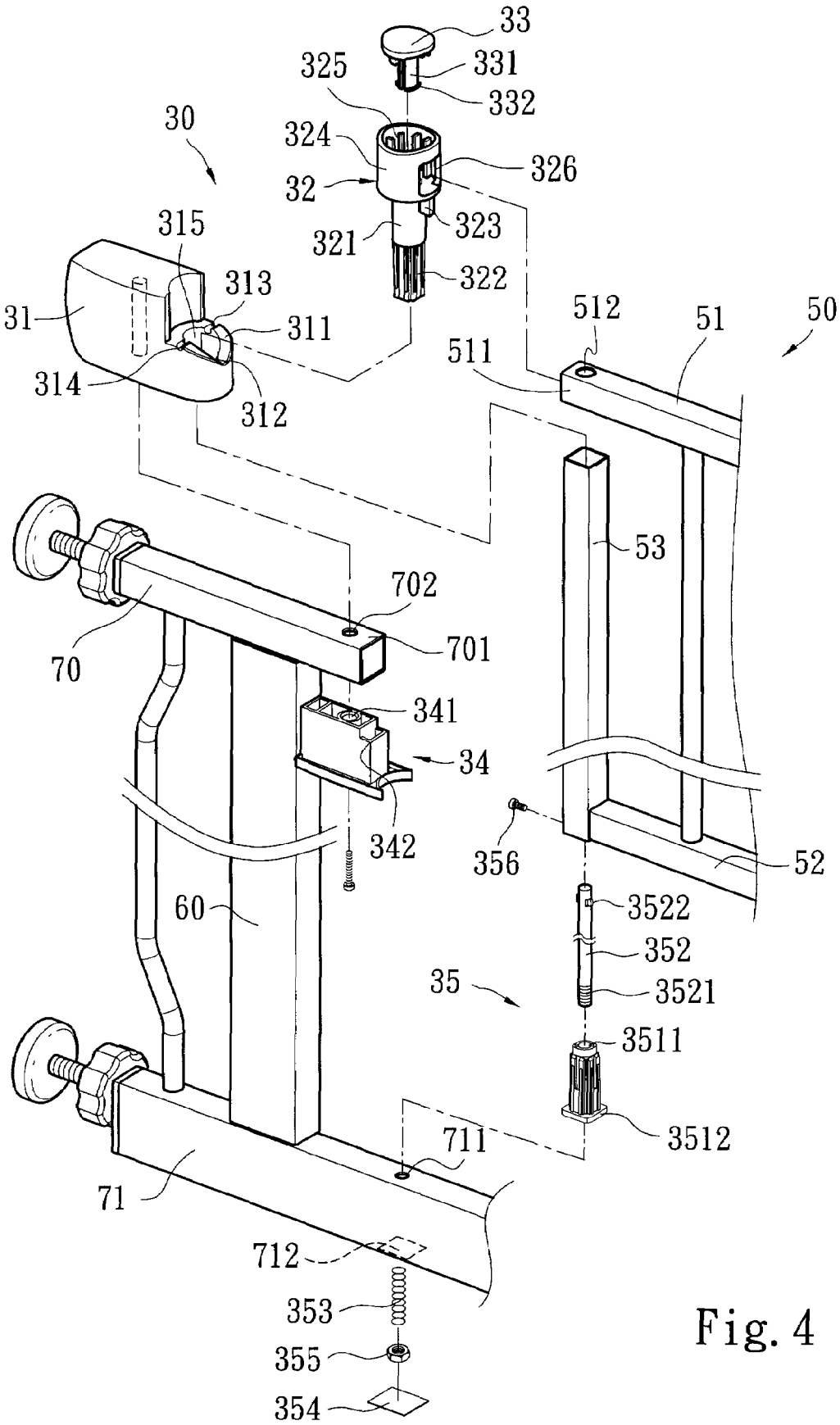
FIG. 4 is an exploded view of the driving means and railing of the invention.
Figure 5:
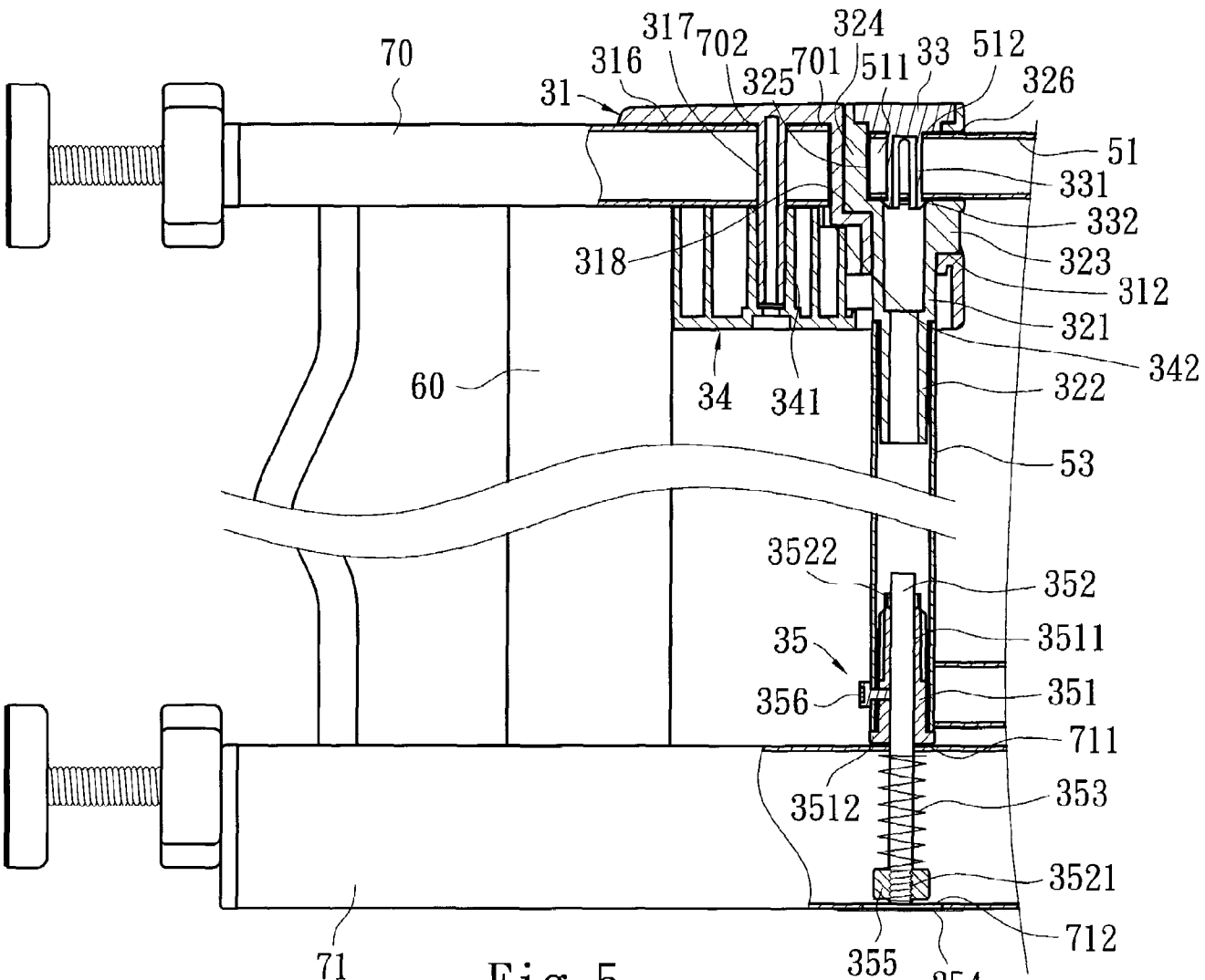
FIG. 5 is a front view of the driving means and railing of the invention in a coupled condition, partly cutaway.

Referring to FIGS. 3, 4 and 5, the driving means 30 is located at the junction of the upper transverse bar 51 and the left post 53, and has at least a seat 31, a turning element 32, an upper cap 33, a base 34 and a fastening means 35.

The seat 31 has a lower side adjacent to the left post 53 and a higher another side. A helical and parabolic surface 311 formed on the top of the lower side of the seat in varying curvatures a, b and c, and the curvatures are a<b<c, referring to FIGS. 6 and 7, the varying curvatures mentioned above aim to provide an automatic return function of any angles formed between turning element 32 and the seat 31 and save labor for closing at small angles. The curved surface 311 has a first notch 312, a second notch 313 and a third notch 314. The first notch 312 is located at the lowest position. The second and third notches 313 and 314 are spaced from the first notch 312 at selected distances to form desired moving angles. The seat 31 further has an opening 315 at one side to be hinged by an axle 321 at the bottom of the turning element 32, and a holding trough 316 and a strut 317 on another side to be coupled with a distal end 701 of the upper beam 70 that has a hole 702 formed thereon.

The axle 321 has a distal end formed with an extended wedge 322 to run through the opening 315 of the seat 31 and into the left post 53. The axle 321 also has an anchor lug 323 at one side movable on the curved surface 311. The turning element 32 has a hollow upper barrel 324 at the top with a housing cavity 325 formed therein and a wedge opening 326 formed thereon. The housing cavity 325 is covered by the upper cap 33. The wedge opening 326 can be wedged in by one end 511 of the upper transverse bar 51 that has an aperture 512 formed thereon.

The upper cap 33 is held on the upper barrel 324 of the turning element 32 and has an elastic element 331 at one side relative to the housing cavity 325. The elastic element 331 has a latch element 332 at two sides of a distal end to run through the one end 511 of the upper transverse bar 51 to latch on the aperture 512.

The base 34 is located at the bottom of the upper beam 70 corresponding to the hole 702 and has a strut cavity 341 at the top to be wedged in by the strut 317, and a recess 342 at one side of the base 34 pressed by a boss 318 formed at a lower portion of one side of the seat 31 for positioning.

The fastening means 35 bridges a distal end of the left post 53 and the lower beam 71, and includes a strut 351, a stem 352, an elastic element 353 and a bonding plate 354. The strut 351 has a through hole 3511 and a bottom plate 3512 at the bottom to be wedged in the distal end of the left post 53 and fastened thereon through a fastening element 356. The stem 352 has an external screw thread 3521 at a tail end and a latch element 3522 close to a top end, and runs through the through hole 3511 of the strut 351 with the latch element 3522 located above the strut 351, and also runs through a corresponding aperture 711 of the lower beam 71. The lower beam 71 has an opening 712 at the bottom corresponding to the aperture 711. The elastic element 353 may be a spring. The tail end of the stem 352 runs through the opening 712 with the external screw thread 3521 fastened to a nut 355. The elastic element 353 is located in the lower beam 71 above the nut 355. The bonding plate 354 is larger than the opening 712 and bonded to an outer side of the lower beam 71.

Referring to FIGS. 3, 8, 9 and 11, the opening/closing means 40 is located at another end of the upper transverse bar 51, and includes an upper cover 41, a depressing means 42, a handgrip means 43, a slider 44, a lower cover 45 and a linkage bar 46.

The upper cover 41 has a first housing chamber 411, a second housing chamber 412 and a third housing chamber 413 that have a top portion holding an elongated round rod 414, an anchor pin 415, a through hole 416 adjacent to the anchor pin 415, a recess 4161, a detent member 418 with a cavity 417 formed thereon to hold a spring 4171, and a latch member 419 extended respectively from a front end and a rear end thereof.

Figure 10A:
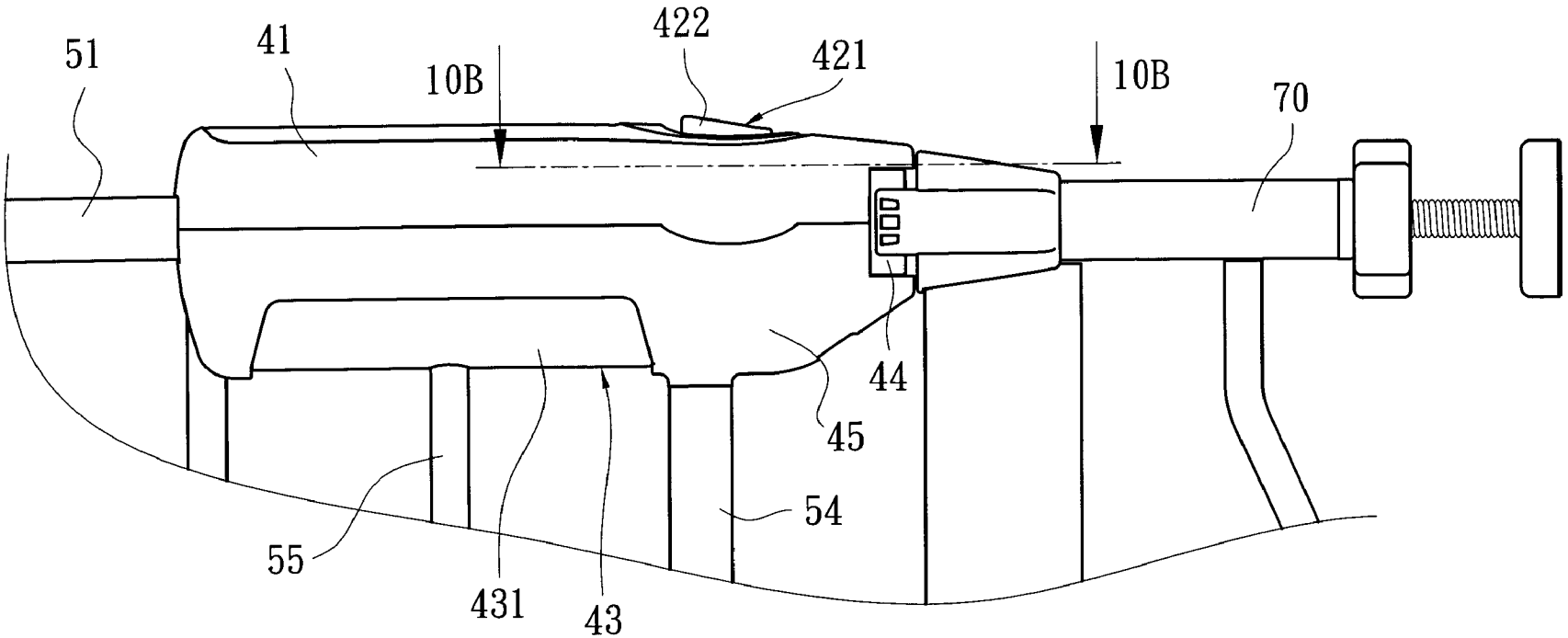
FIG. 10A is a front view of the opening/closing means and railing of the invention in a coupled condition.
Figure 10B:
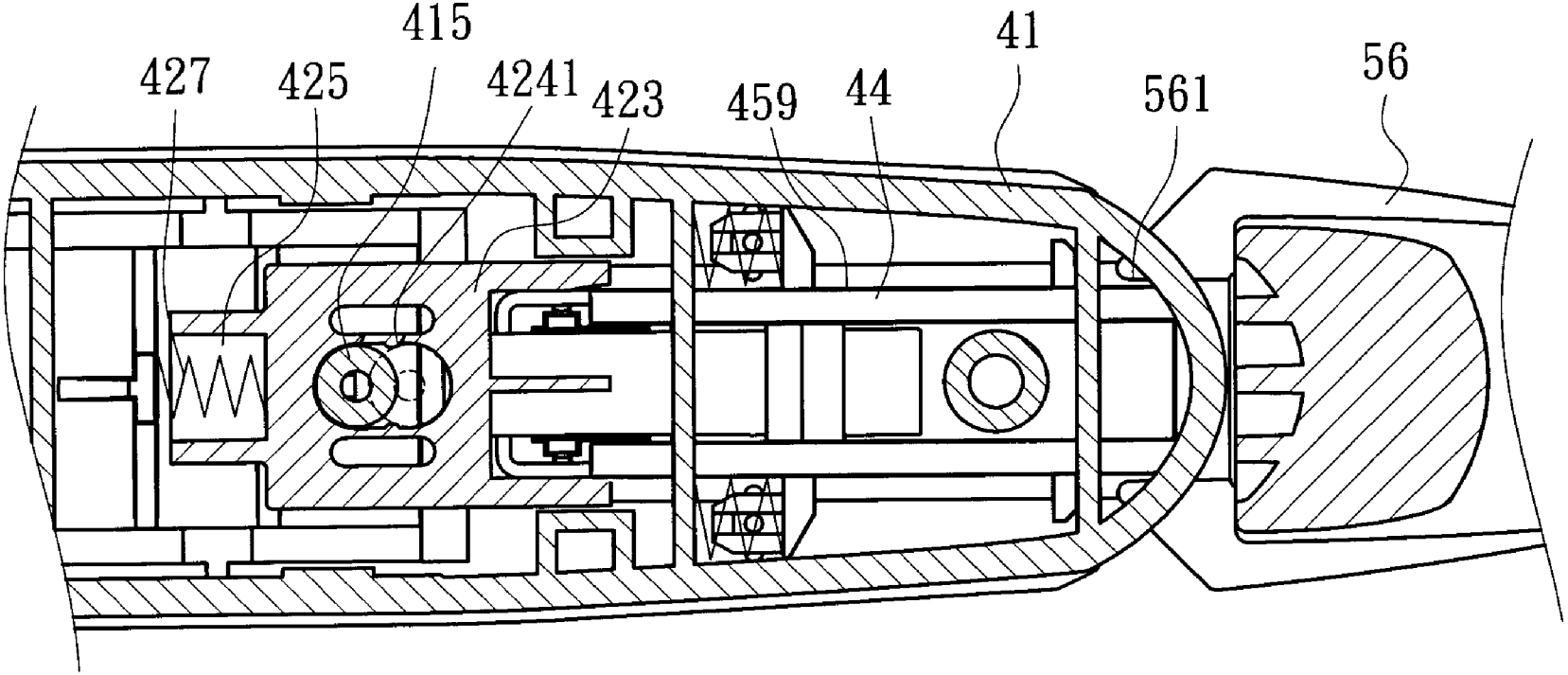
FIG. 10B is a cross section taken on line 10B-10B in FIG. 10A.

The depressing means 42 has a depressing member 421 and an elastic element 427. The depressing member 421 has a slant depressing element 422 at one end running through the through hole 416 of the upper cover 41 to be located above the recess 4161. The slant depressing element 422 has a moving portion 423 located at an inner side bending downwards with a slot 424 formed thereon. The slot 424 has two inner sides with a boss 4241 formed respectively thereon to hold the anchor pin 415. Also referring to FIGS. 10A and 10B, the moving portion 423 has a strut 426 at an outer side with a cavity 425 formed thereon. The strut 426 further has a diagonal distal end 4261 with a round surface 4262 formed thereon. The elastic element 427 is held in the cavity 425.

The handgrip means 43 is located on a slot 451 formed at one side of the lower cover 45, and has an arched cradle 431 with an upper opening at one end that has a wedge member 432 located respectively on a front end and a rear end thereof with a latch element 433 and 434 at two sides, and a wedge 435 extended from one side. The wedge 435 has an inclined element 436 on an outer side. The arched cradle 431 further has a double strut 437 inside to couple with the spring 4171 held in the cavity 417 of the upper cover 41 and two opposing directing elements 438 and 4381 that form a directing trough 439 between them to receive the strut 426 of the depressing member 421. The double strut 437 has a trough 4371 inside to hold the linkage bar 46 and corresponding apertures 4372 on two sides to hold a pin 4373 which also runs through the linkage bar 46 for anchoring.

The slider 44 is hollow and located above the inclined element 436 of the wedge 435, and has an opening side 441 at one side and a closed side 442 at another side, and two lugs 443 extended vertically from a front end and a rear end close to the opening side 441 to hold two springs 444. The two lugs 443 are bridged by a connection element 445 movable rearwards when the inclined element 436 is moved upwards, and movable forwards when the inclined element 436 is moved downwards caused by the returning force of the springs 444. The closed side 442 has a brake element 446 respectively on a front end and a rear end thereof to be stopped by two stoppers 458 of the lower cover 45 from sliding outside.

The lower cover 45 mates the upper cover 41 to form coupling therewith. It has the slot 451 at one side to hold the arched cradle 431. The slot 451 has two flanges 450 and 4500 at two sides to be rested by the latch elements 433 and 434 of the arched cradle 431 (also referring to FIGS. 8 and 11). One side where the flange 450 is located has a holding trough 4501 with two corresponding clipping walls 4502 formed thereon. The clipping walls 4502 have pin holes 4503 close to an upper end to receive a set pin 4504 to fasten the upper transverse bar 51 by running through an aperture 513 formed at one end thereof. The lower cover 45 further has two notches 452 on an inner side of two corresponding ends to be latched by the latch members 419 of the upper cover 41, and corresponding directing troughs 453 on the inner side to facilitate up and down movements of the wedge members 432 of the handgrip means 43. It also has a housing compartment 454 at another side to hold the inclined element 436 of the wedge 435. The housing compartment 454 has a plurality of reinforced elements 455 at the front end and the rear end of the inner side thereof, and two mask walls 456 extended upwards from one side, and a strut 457 at another side and the two stoppers 458 at yet another side extended inwards. The reinforced elements 455 form a sliding trough 459 to allow the slider 44 to slide forwards and rearwards (referring to FIG. 10B). The strut 457 serves as a rear anchor position of the slider 44. When the slider 44 is moved forwards, the springs 444 at one side of the two mask walls 456 provide counter elastic forces, and the two brake elements 446 are stopped by the two stoppers 458 of the lower cover 45 for anchoring. The lower cover 45 further has a conical strut 4541 at a distal end of another side to wedge in the right post 54. The conical strut 4541 has an opening 4542 leading to the housing compartment 454 and an elastic reed 4543 at one side that has a bulged spot 4544 at the distal end thereof to latch on a corresponding aperture 541 formed on the right post 54 (referring to FIG. 11) so that the lower cover 45 and the right post 54 can form a secured coupling.

The linkage bar 46 has a head 462 at the top with a hole 461 formed thereon to be inserted into the trough 4371 of the double strut 437. The pin 4373 runs through the apertures 4372 and the hole 461 to hold the linkage bar 46 in the handgrip means 43. The linkage bar 46 has a distal end formed a round bar 463 to extend outside one bracing bar 55 and latch in an anchor hole 712 of the lower beam 71.

The railing 50 is located between the left and right anchor posts 60 and 61, and the upper and lower beams 70 and 71. The railing 50 has the latch member 56 latched on the upper beam 70 corresponding to the top of the right anchor post 61. The latch member 56 has two opposing and jutting diagonal clipping ends 562 at one side with a latch notch 561 formed to be wedged in by the slider 44 (referring to FIG. 8). Thus when the opening/closing means 40 is closed, the slider 44 is wedged in the latch notch 561. The lower beam 71 has an anchor member 711 with the anchor hole 712 formed thereon to be latched by the round bar 463 of the linkage bar 46 for anchoring. Thus, the railing 50, aside from latched by the opening/closing means 40 at the upper end, also is latched by the round bar 463 at the lower end. Therefore a double anchoring is formed to enhance safety.

Figure 11:
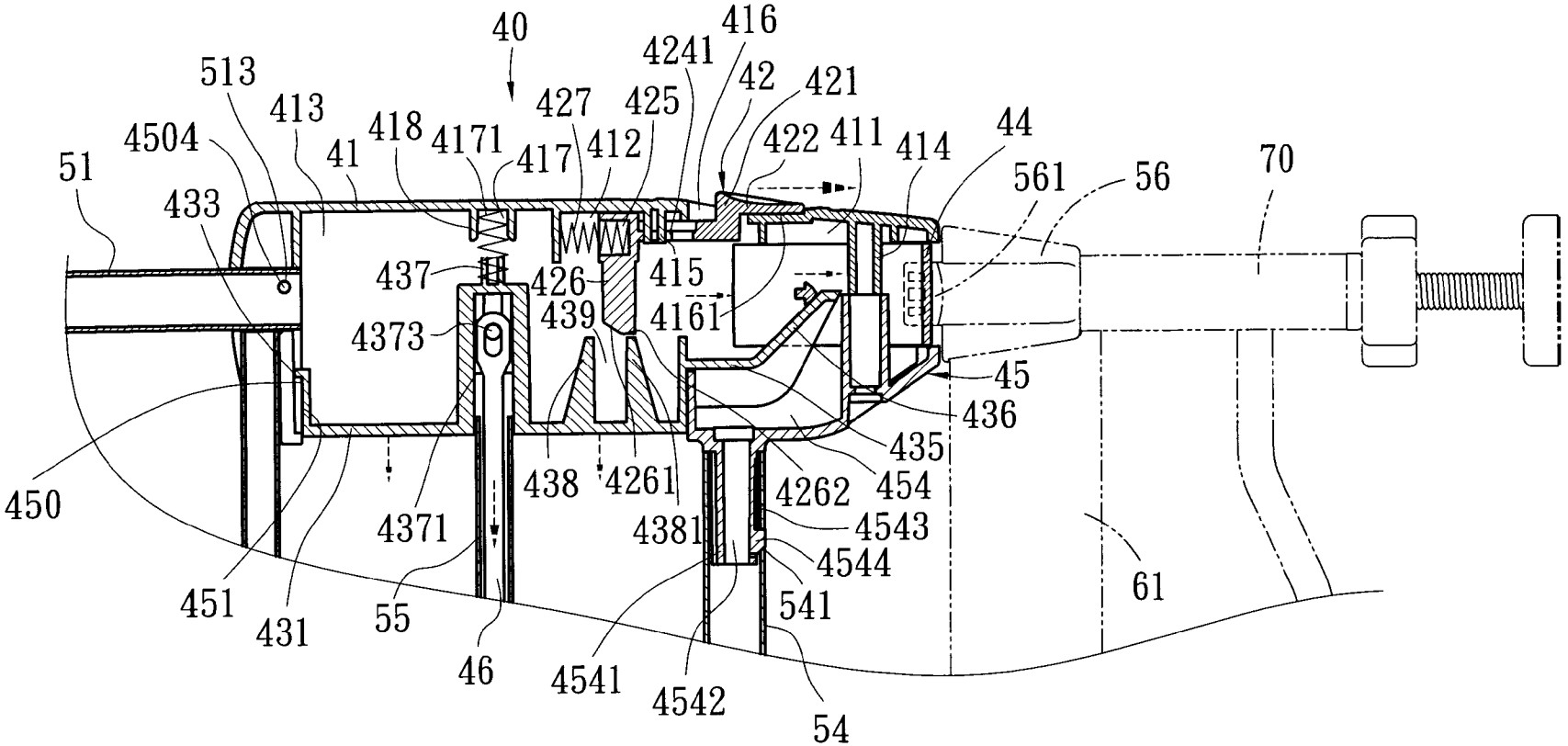
FIG. 11 is a schematic view of the opening/closing means and railing of the invention in a latched condition.

Referring to FIGS. 3 and 11, when the railing 50 is closed, the anchor lug 323 of the turning element 32 is held in the lowest first notch 312, and the round surface 4262 of the strut 426 is located above another directing element 4381. The slider 44 is latched in the latch notch 561 of the latch member 56 to form a latched condition.

Figure 12:
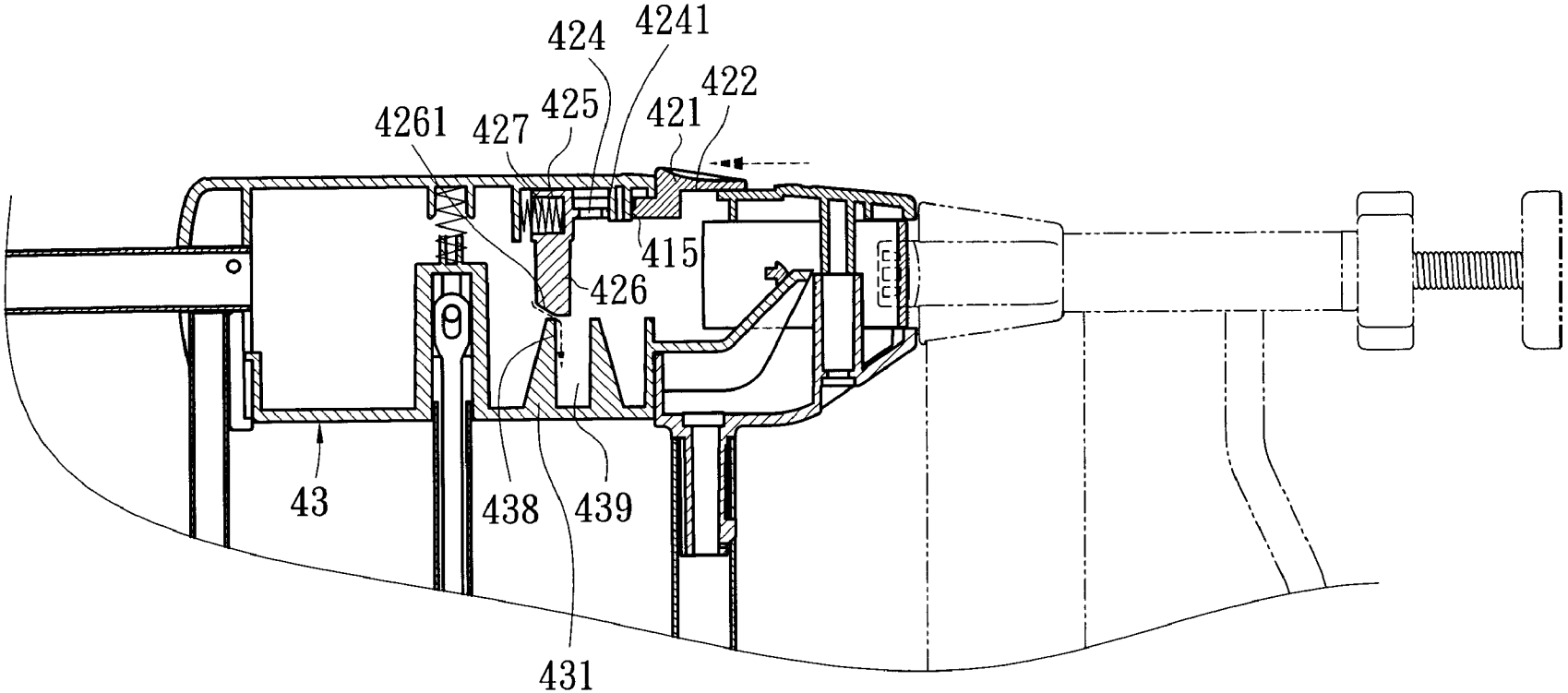
FIG. 12 is a schematic view of the opening/closing means of the invention with the condition of the depressing member moved leftwards.
Figure 13:
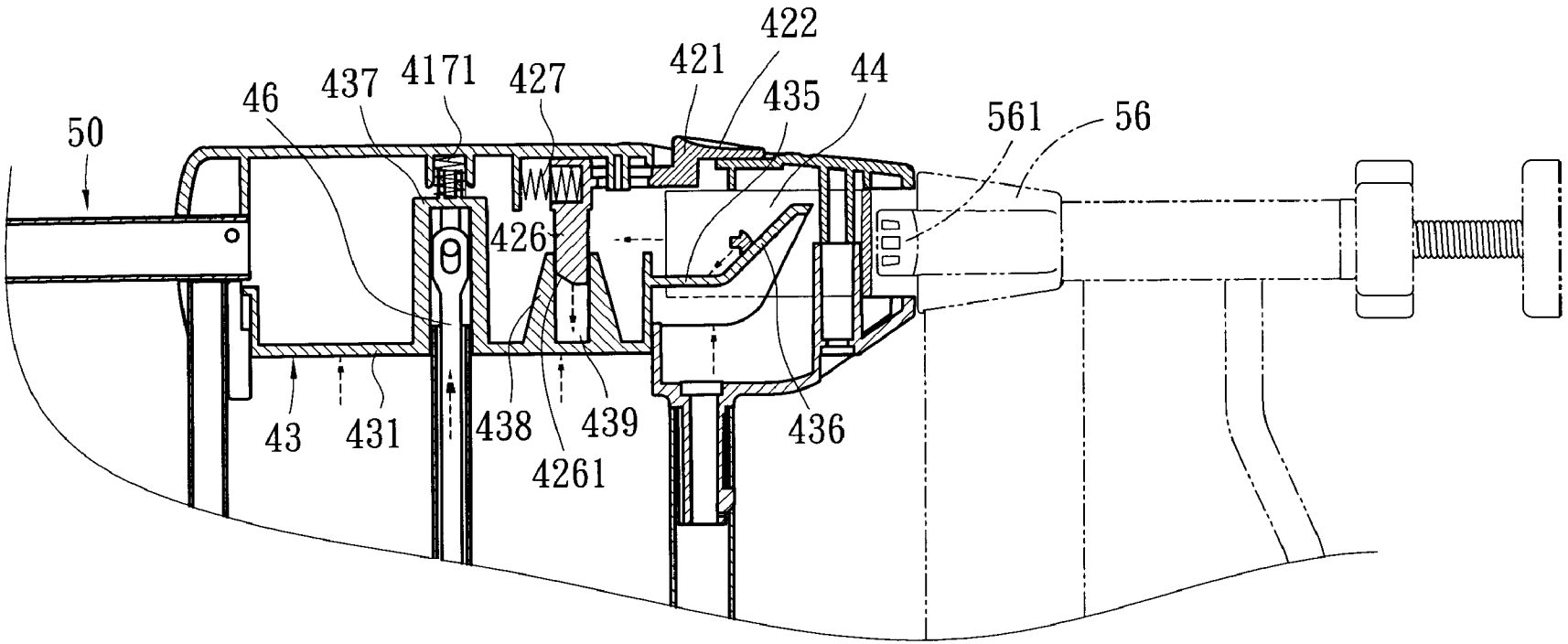
FIG. 13 is a schematic view of the opening/closing means of the invention with the condition of the handgrip means moved upwards.
Figure 14:
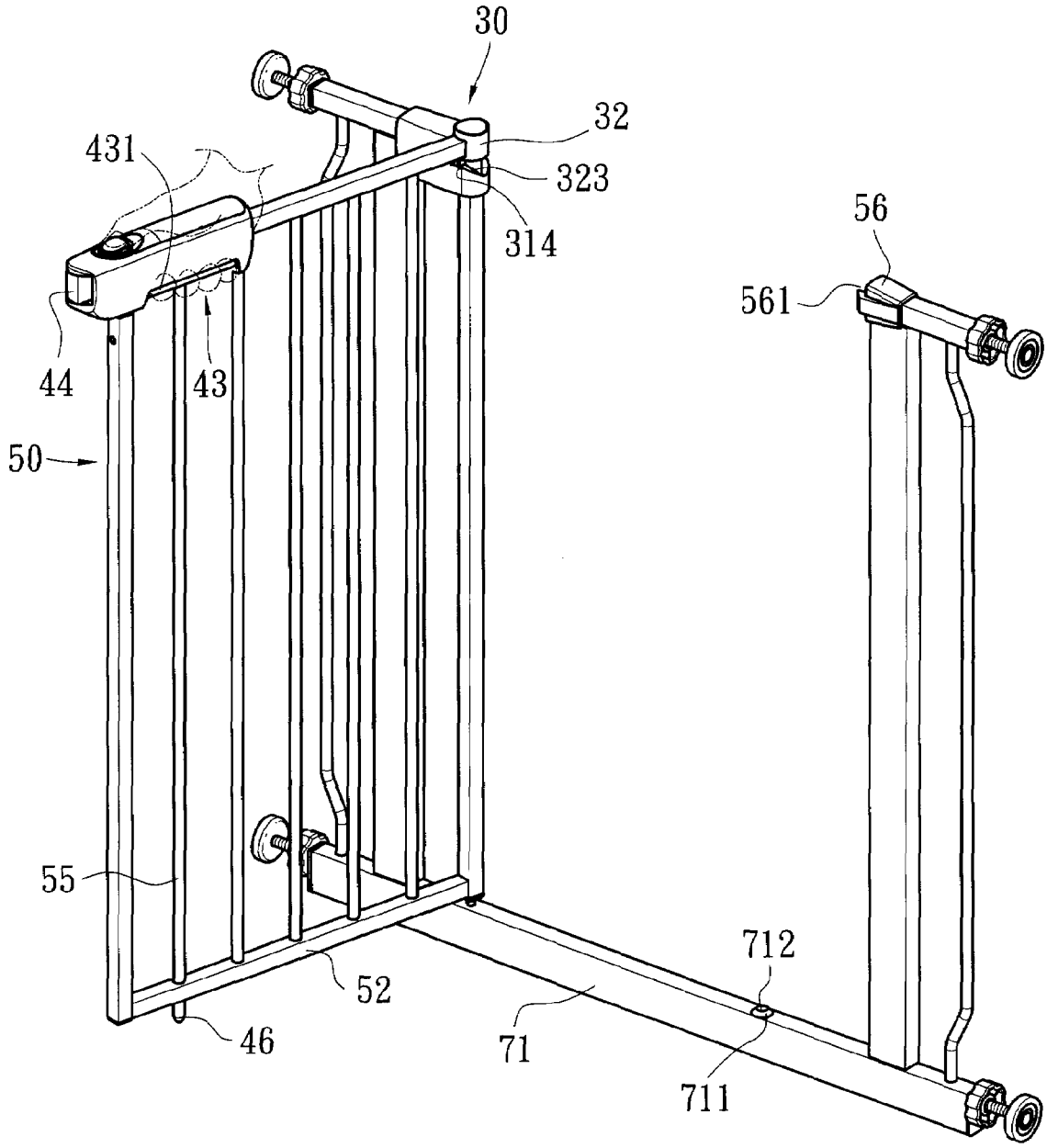
FIG. 14 is a perspective view of the railing of the invention in an open condition.

Referring to FIGS. 12 and 14, to open the railing 50 by pushing outwards or inwards, first, move the slant depressing element 422 rearwards single-handed; the anchor pin 415 is moved to the front end of the slot 424 and latched by the bosses 4241. The depressing member 421 shall not return by the elastic force exertion of the compressed elastic element 427 held in the cavity 425. And the strut 426 remains at the anchor position above the corresponding directing element 438 of the handgrip means 43. Referring to FIGS. 12, 13 and 14, after the arched cradle 431 is moved upwards, the strut 426 receives a counter reaction force of the compressed elastic element 427 and moves rightwards; the diagonal distal end 4261 of the strut 426 slides along the directing element 438 into the directing trough 439, meanwhile the inclined element 436 of the wedge 435 drives the slider 44 leftwards to escape the latch notch 561 of the latch member 56. The linkage bar 46 also escapes the anchor hole 712 of the lower beam 71. Referring to FIG. 14, when the railing 50 is opened by pushing outwards, the anchor lug 323 swivels on the helical parabolic surface 311 from the original first notch 312 to any angle desired. If the opened angle is smaller than 90 degrees, the railing 50 can automatically return and close to be latched after released. In the event that the railing 50 is opened at an angle greater than 90 degrees, the anchor lug 323 can be latched in the third notch 314 (also referring to FIGS. 6 and 7). When the arched cradle 431 is released, it is moved automatically downwards due to the counter reaction force of the spring 4171. The linkage bar 46 held in the bracing bar 55 is extended outside the lower transverse bar 52 as shown in FIG. 11; the lugs 443 at the two ends of the wedge 435 receive the counter reaction force of the compressed spring 444 to move the slider 44 rightwards; the depressing member 421 receives the counter reaction force of the elastic element 427 and returns to the original latched condition.

Figure 6:
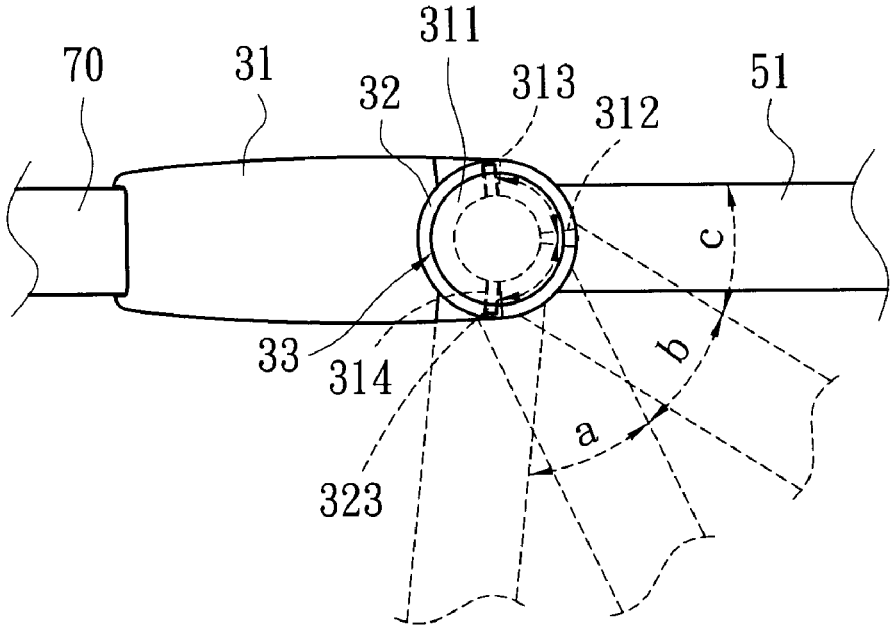
FIG. 6 is a fragmentary schematic view of the driving means and railing of the invention in an open or automatic return condition at any angles.
Figure 7:
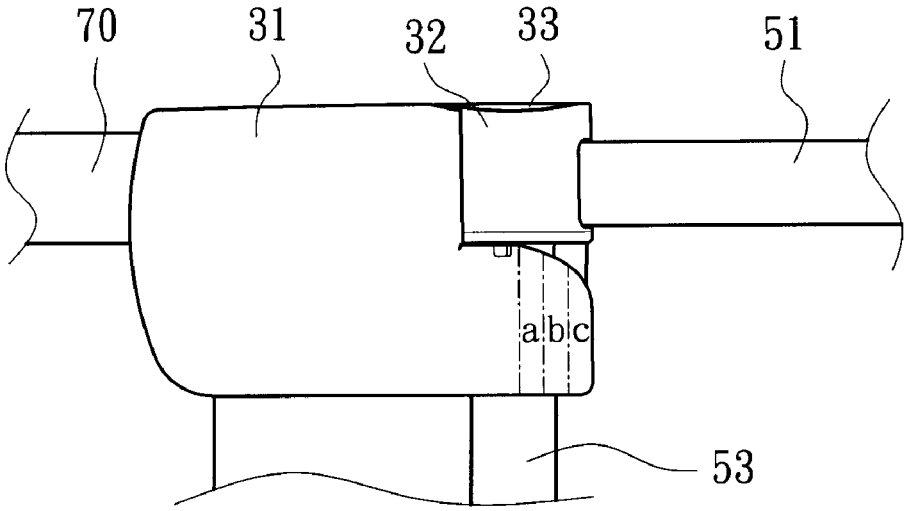
FIG. 7 is a front view of the seat of the driving means of the invention formed with a helical parabolic top surface.
Figure 8:
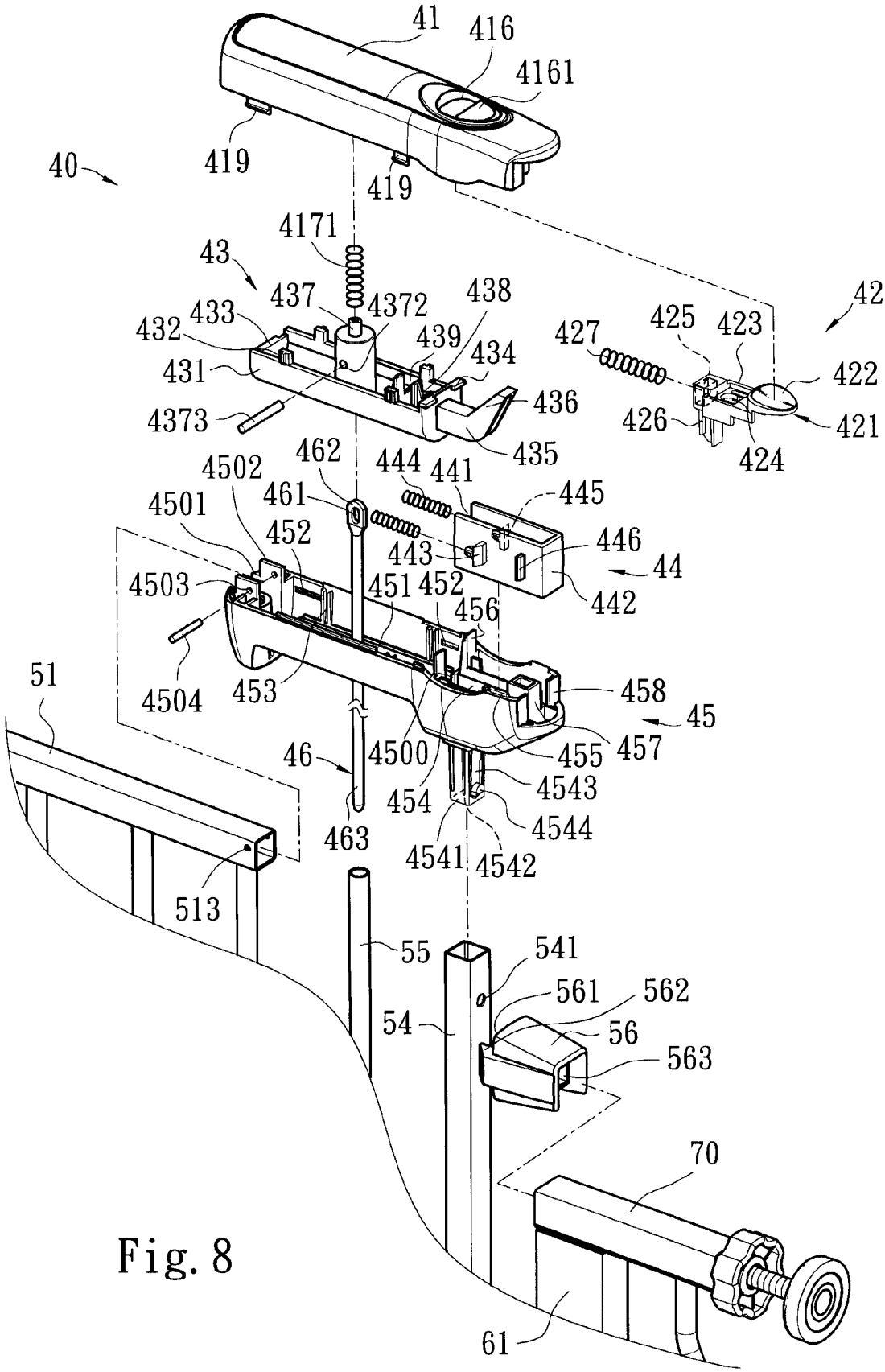
FIG. 8 is an exploded view of the opening/closing means and railing of the invention.
Figure 9:
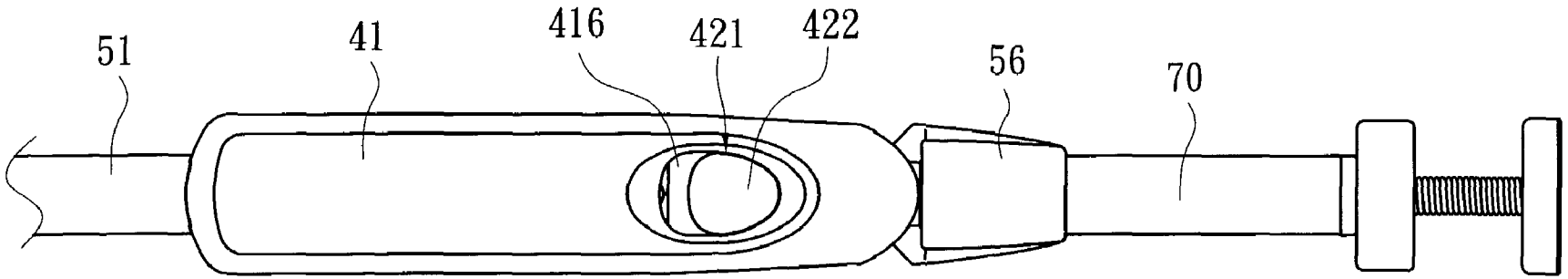
FIG. 9 is a top view of the opening/closing means and railing of the invention in a coupled condition.
Figure 15:
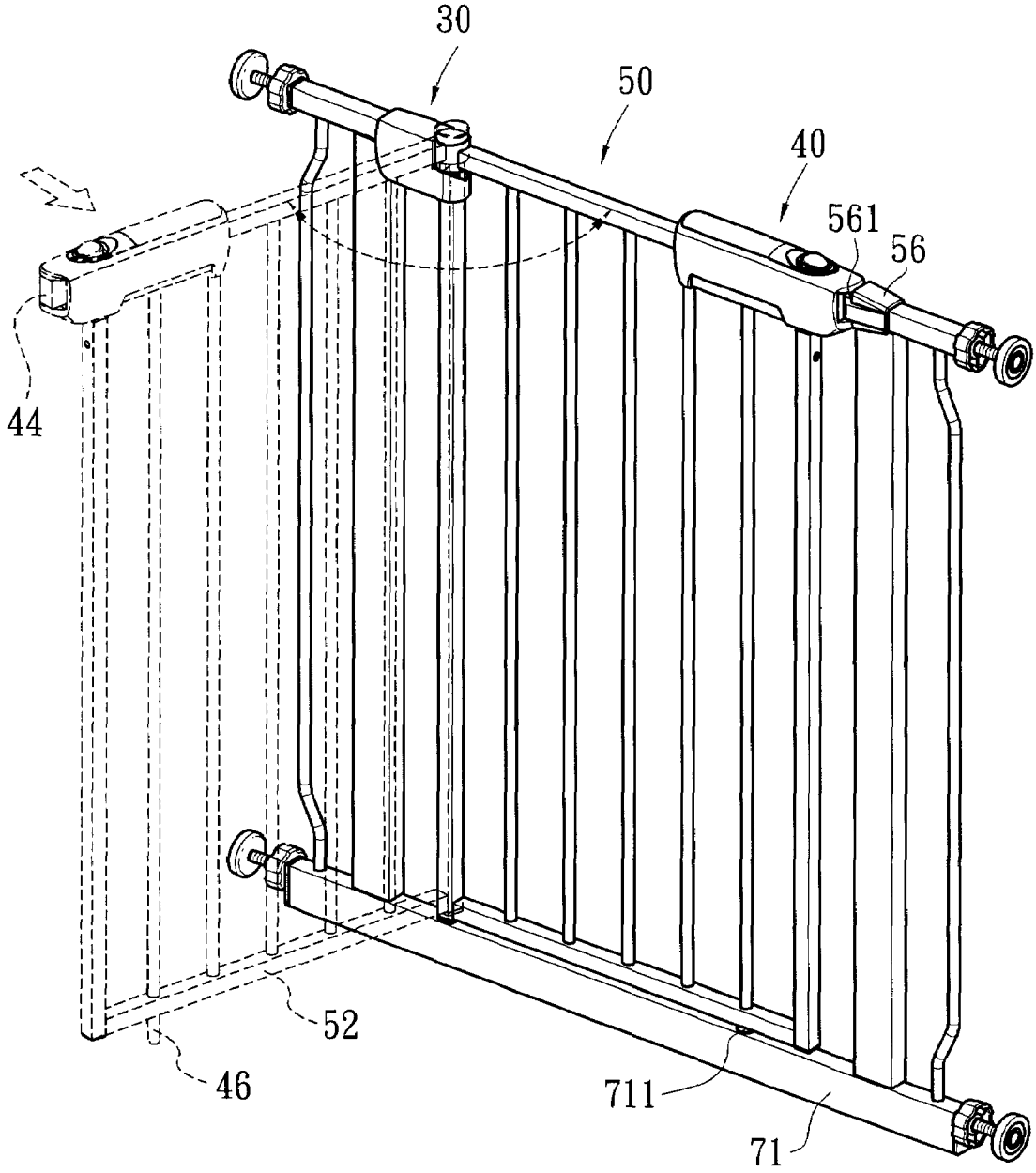
FIG. 15 is a schematic view of the railing of the invention in an automatic closing condition.

Referring to FIGS. 15 and 6, when the railing 50 is closed by pushing, the anchor lug 323 swivels from the originally latched third notch 314 of the curved surface 311 to the lowest first notch 312 to be latched, and the slider 44 is latched in the latch notch 561. The linkage bar 46 extended outside the lower transverse bar 52 also is latched on the anchor member 711 of the lower beam 71. Thus the upper and lower ends of the railing 50 are securely latched.

What is claimed is:

1. A crib railing, comprising:

a driving means which is located at one end of one side of a railing and includes at least a seat, a turning element, an upper cap, a base and a fastening means; the seat having a top helical parabolic surface formed thereon that has a lowest first notch and a second notch and a third notch spaced from the first notch at selected distances; the turning element running through the seat and having an axle at the bottom formed with an extended wedge at a distal end thereof and an anchor lug at one side; the upper cap being coupled with the turning element; the base having a recess at one side rested by a lower portion of one side of the seat for anchoring; the fastening means being located at another end of the one side of the railing opposing the one end thereof; and an opening/closing means which is located at one end of another side of the railing and includes at least an upper cover, a depressing means, a handgrip means, a slider, a lower cover and a linkage bar; the upper cover having a through hole, an elongated round rod, an anchor pin adjacent to the through hole, a recess and a detent member; the depressing means having a depressing member and an elastic element coupled on one side of the depressing member; the depressing member having a slant depressing member at one end running through the through hole of the upper cover; the slant depressing member having a moving portion located at an inner side thereof bending downwards with a slot formed thereon; the slot having corresponding bosses to hold the anchor pin; the moving portion having a strut at an outer side; the handgrip means being located at one side of the lower cover and having a wedge extended from one side thereof that has an inclined element on an outer side and a double strut inside to couple with the spring and two opposing directing elements that form a directing trough between them to receive the strut; the slider being located above the inclined element of the wedge and driven by the inclined element of the wedge to be latched on a latch member of the railing; the lower cover mating the upper cover to form coupling therewith and having a slot at one side to be coupled with the handgrip means and a housing compartment at another side to hold the inclined element of the wedge and a conical strut at a distal end thereof to wedge in the railing; the linkage bar being inserted into the double strut and movable up and down in the handgrip means to allow the railing be opened and latched;

wherein the railing has the one end fastened to the driving means and the latch member at another end latched with the opening/closing means; located between a left anchor post and a right anchor post and between an upper beam and a lower beam which has an anchor member and is around an upper transverse bar, a lower transverse bar, a left post, a right post and a plurality of bracing bars.

2. The crib railing of claim 1, wherein the seat has an opening at one side and a holding trough and a strut at another side.

3. The crib railing of claim 1, wherein the turning element has a hollow upper barrel at the top that has a housing cavity and a wedge opening formed thereon.

4. The crib railing of claim 1, wherein the upper cap of the driving means is held in the turning element and has an elastic element at one side with a latch element formed respectively at two sides of a distal end thereof.

5. The crib railing of claim 1, wherein the fastening means has a strut which has a through hole inside and a bottom plate at the bottom thereof.

6. The crib railing of claim 1, wherein the fastening means has a strut to receive a stem which has a distal end coupled with an elastic element and a nut and a latch elements close to a top end thereof.

7. The crib railing of claim 6, wherein the elastic element is a spring.

8. The crib railing of claim 1, wherein the upper cover of the opening/closing means has a first housing chamber, a second housing chamber and a third housing chamber and a latch member extended respectively from a front end and a rear end thereof.

9. The crib railing of claim 1, wherein the moving portion has a strut at an outer side that has a cavity to hold an elastic element and a diagonal distal end and a round surface on the distal end.

10. The crib railing of claim 9, wherein the elastic element is a spring.

11. The crib railing of claim 1, wherein the handgrip means has a hollow arched cradle at one end that has a wedge member located respectively on a front end and a rear end thereof with a latch element located respectively on two sides.

12. The crib railing of claim 1, wherein the double strut has a trough inside and corresponding apertures formed on two sides thereof.

13. The crib railing of claim 1, wherein the slider has an opening side at one side and a closing side at another side; two lugs extended from a front end and a rear end close to the opening side to hold two springs, the two lugs being bridged by a connection element; the slider having a brake element located respectively on a front end and a rear end close to the closed side stopped by the lower cover.

14. The crib railing of claim 1, wherein the lower cover of the opening/closing means has two flanges at two sides and a notch on an inner side of two corresponding ends and corresponding directing troughs on the inner side to facilitate up and down movements of the handgrip means.

15. The crib railing of claim 14, wherein the lower cover has a plurality of reinforced elements at a front end and a rear end of an inner side of the housing compartment, two mask walls extended upwards from one side and a strut at another side and the two stoppers at yet another side extended inwards.

16. The crib railing of claim 1, wherein the conical strut has an elastic reed at one side that has a distal end formed with a bulged spot to latch on the railing.

17. The crib railing of claim 1, wherein the linkage bar has a head at the top formed with a hole run through by a pin to latch on the handgrip means.

18. The crib railing of claim 17, wherein the linkage bar has a round bar at a distal end thereof latching on an anchor member of the lower beam.

19. The crib railing of claim 18, wherein the lower beam has an anchor hole corresponding to the anchor member and bonding to a bonding plate.

20. The crib railing of claim 1, wherein the railing has a latch member on the top thereof latched on the upper beam, the latch member having two jutting diagonal clipping ends at one side that have a latch notch formed thereon.

* * * * *